United States Patent [19]

McDonald

[11] 4,399,903

[45] Aug. 23, 1983

[54] ENLARGED COIN BOX FOR PRODUCT DISPENSER

[76] Inventor: Winford G. McDonald, 128 Hill, Center, Tex. 75935

[21] Appl. No.: 330,951

[22] Filed: Dec. 15, 1981

Related U.S. Application Data

[63] Continuation-in-part of Ser. No. 210,224, Nov. 25, 1980, Pat. No. 4,363,392.

[51] Int. Cl.[3] ..... G07F 9/06

[52] U.S. Cl. ..... 194/1 F; 194/1 B; 232/15

[58] Field of Search ..... 194/1 R, 1 A, 1 B, 1 F; 232/15

[56] References Cited

U.S. PATENT DOCUMENTS 1,879,884 9/1932 Rowe ..... 194/1 R

*Primary Examiner*—Joseph J. Rolla
*Assistant Examiner*—Kevin P. Shaver
*Attorney, Agent, or Firm*—D. Paul Weaver

[57] ABSTRACT

To greatly increase the coin holding capacity of the cash box of one well known product dispenser and to simplify and render more convenient the placement of the cash box in the dispenser, the cash box is restructured to utilize all available space in the dispenser without interfering with or changing in the slightest the operation of the coin mechanism and the associated product dispensing components. In lieu of a lock, the cash box is held securely in its working position by simple spring pressure. The improved cash box is equally adaptable to double or single column product dispensers.

9 Claims, 7 Drawing Figures

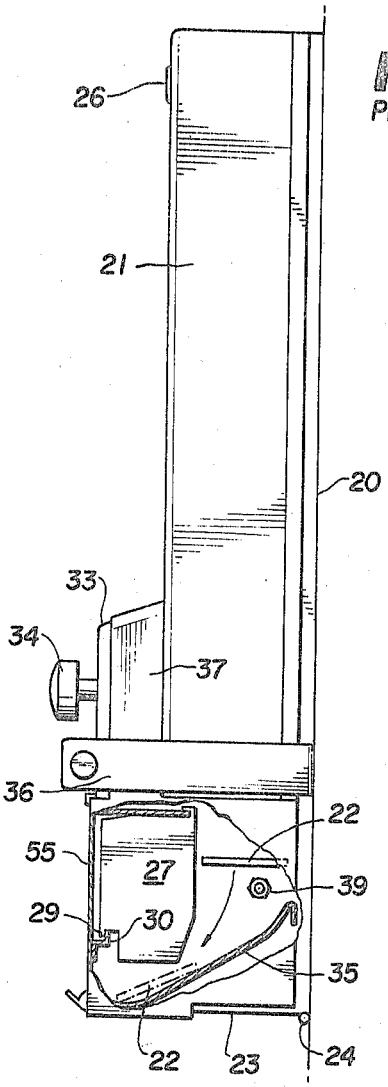
FIG. 1
PRIOR ART
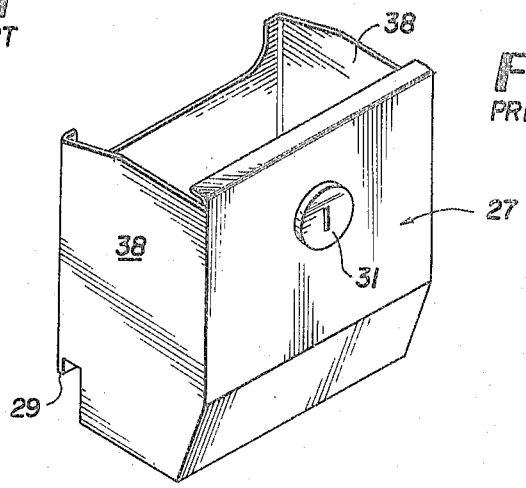
FIG. 2
PRIOR ART
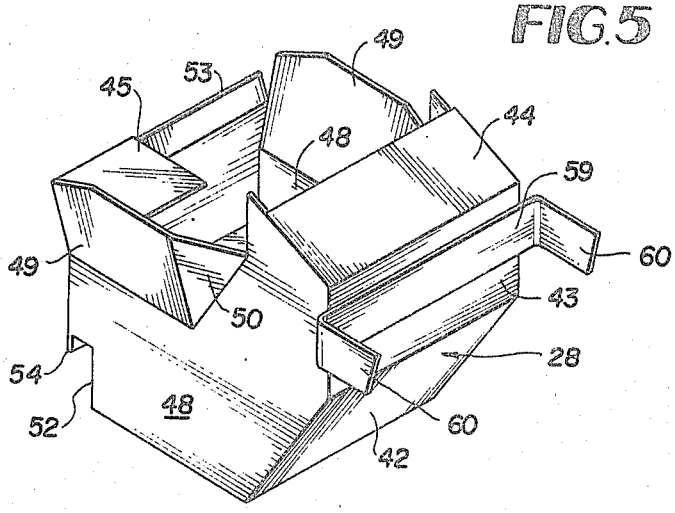
FIG. 5
FIG. 3
PRIOR ART
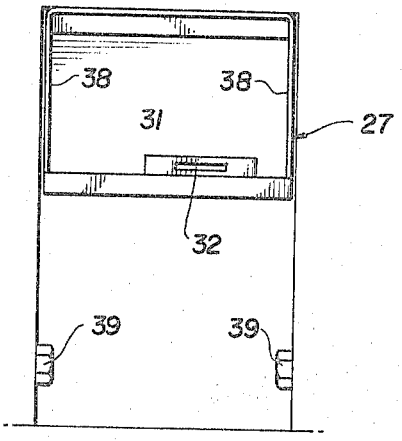
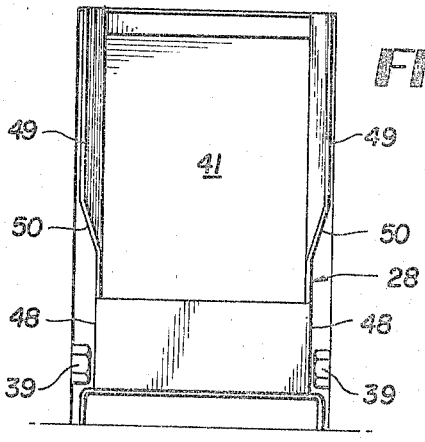
FIG. 4

ENLARGED COIN BOX FOR PRODUCT DISPENSER

CROSS-REFERENCE TO RELATED APPLICATION

This application is a continuation-in-part of copending application Ser. No. 210,224, filed Nov. 25, 1980 now U.S. Pat. No. 4,363,392, for PRODUCT DISPENSER HAVING INCREASED COIN HOLDING CAPACITY.

BACKGROUND OF THE INVENTION

The above-referenced parent application fully details economic changes which have led to the requirement for increasing the coin holding capacity of the cash box in a well-known type of dispenser where the cost of the product has drastically increased over the years.

In the parent application, the problem of enlarging the cash box was dealt with by extending the bottom of the dispenser housing and guard structure below the lower end of the wall attached mounting plate for the dispenser without altering the structure of the latter and thus allowing continued normal usage of existing installations with easy modification. The resulting lower extension was tapered downwardly with a steeply inclined bottom wall. The enlarged cash box was given substantially the shape of the lower extension of the housing and guard structure. While the result achieved is quite satisfactory in terms of increased capacity for the cash box, the modification of the housing and guard structure is a bit costly and, accordingly, the objective of the present invention is to achieve the same result sought in the parent application by means of even simpler and less costly means.

In accordance with the present invention, almost no modification of existing dispenser housing and guard structure is required for the acceptance of a cash box which is more than double the capacity in quarters of the largest prior art box. Furthermore, the improved cash box is constructed in such a way that it is more convenient to introduce into and remove from the dispenser, in that interference with two existing nuts on opposite sides of the dispenser cabinet or housing used to secure a cash box guard is entirely avoided.

Another improvement is achieved by the invention in that in lieu of a mechanical lock for the cash box, the latter is firmly and securely held in place by spring pressure when the dispenser is swung to its operational position against the wall attached support plate. The entire structure is simple, convenient to use, and very economical to manufacture. Its use renders the conversion of existing machines in the field to larger more practical cash boxes entirely feasible and economically sound.

Other objects and advantages of the invention will become apparent during the course of the following detailed description.

BRIEF DESCRIPTION OF THE DRAWINGS

FIG. 1 is a side elevation, partly in cross section, showing the prior art.

FIG. 2 is a perspective view of a prior art cash box of inadequate coin holding capacity for present day usage.

FIG. 3 is a partly schematic plan view showing the prior art cash box in relation to existing obstructing nuts on the dispenser.

FIG. 4 is a similar view showing the improved cash box according to the present invention in relation to the obstructing nuts on the dispenser.

FIG. 5 is a perspective view of the cash box.

DETAILED DESCRIPTION

Figure 6:
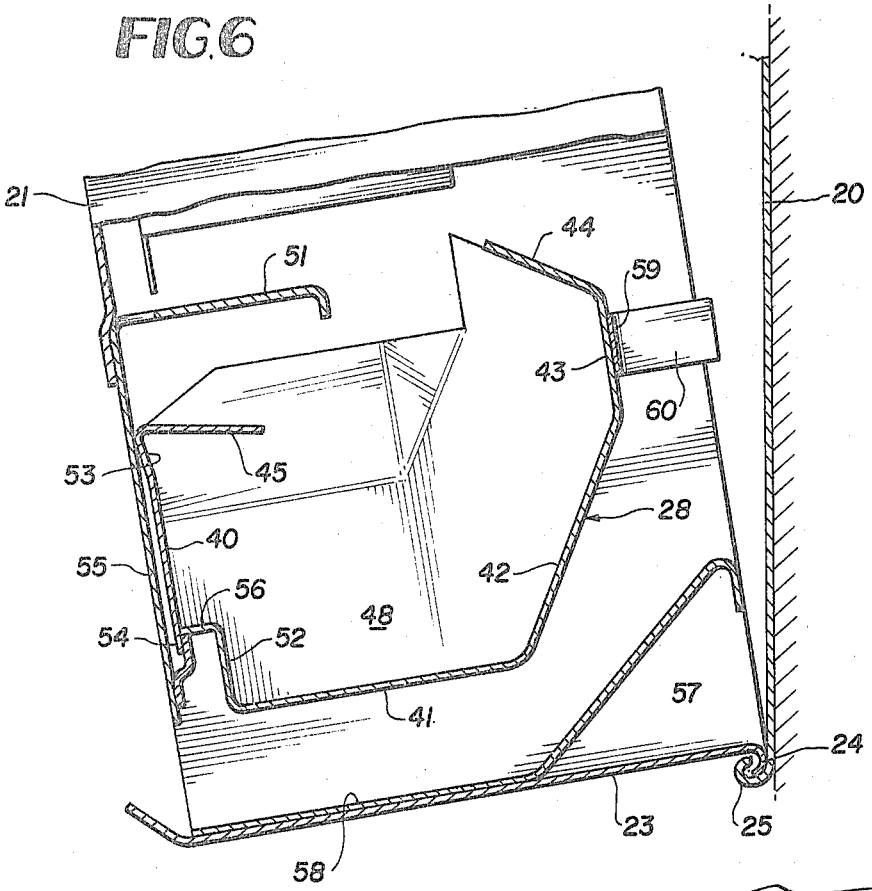
FIG. 6 is a vertical section taken through the cash box and lower portion of the dispenser while the latter is swung forwardly from the wall attached mounting plate.

Referring to the drawings in detail wherein like numerals designate like parts, there is illustrated in FIG. 1 a well known product dispenser of the type disclosed in U.S. Pat. Nos. 1,043,374; 1,925,676; 1,960,065 and others. Such dispensers include a vertical wall attached back or mounting plate 20 for the dispenser on which the entire machine is hung and supported. More particularly, a vertically elongated cabinet body 21 containing multiple or single columns of product units 22 includes a bottom horizontal wall 23 having a rear knuckle 24 which interfits hingedly with a mating knuckle 25 on the bottom end of wall attached plate 20. The top end of the cabinet body carries a key lock 26 which, upon release, allows the entire dispenser to tilt forwardly as indicated in FIG. 6 so that it can be reloaded with the product and also enabling removal and emptying of the cash box.

As shown in FIG. 1, the prior art cash box 27 which is replaced by the enlarged cash box 28 forming the principal subject matter of this invention is contained in the lower portion of the dispenser and has a forward lip 29 engaged with a fixed bracket 30 on the front wall of the dispenser to support the weight of the cash box. The prior art cash box 27 also customarily is provided on its rear wall with a key-operated lock 31 whose bolt 32 can engage a suitable keeper, not shown, in the dispenser structure. This key-operated lock on the cash box is entirely eliminated by the present invention.

The prior art dispenser following placement of proper coins in a coin mechanism 33 and turning of the dispensing knob 34 releases the product units 22 one at a time from one or two storage columns in the cabinet body 21, and the product units fall by gravity onto an inclined panel 35 near the bottom of the structure beneath and behind the cash box 27, where they slide forwardly to a position where they can be removed by the fingers of a customer. The dispenser also includes a cash box guard 36 including a portion 37 which surrounds the coin mechanism above the cash box, the side wall of this guard being partly broken away in FIG. 1 to reveal the cash box and associated elements.

In addition to having insufficient coin holding capacity for present day usage, the cash box 27 has parallel vertical side walls 38 which cannot clear two internal nuts 39 in the lower portion of the dispenser which receive bolts used to anchor the guard structure 36 in place. Consequently, the prior art cash box 27, when installed and removed, had to be lifted up and over the two obstructing nuts 39, which is inconvenient and can result in the spillage of coins. It will be seen that the enlarged cash box 28 according to the invention completely obviates this difficulty.

Continuing to refer to the drawings, the enlarged cash box 28 gains most of its additional size by being extended rearwardly from its front wall 40. Its bottom wall 41 is rendered wider in the front-to-back direction, and its rear wall has a steeply inclined lower portion 42 rising from the bottom wall 41 and joined with a relatively short vertical rear wall portion 43, in turn leading to a short upwardly inclined forwardly extending top wall 44 whose leading edge terminates approximately above the lower end of inclined wall portion 42. The remainder of the top of the cash box 28 is open except for a coin deflector 45 at one forward corner thereof arranged during use immediately below a slot 46 through which all descending coins, such as quarters 47, fall during the operation of the dispenser. They are deflected by the element 45 toward the center of the cash box 28 where they will tend to pile up evenly.

The enlarged cash box 28 has vertical side walls 48 whose spacing will allow the cash box to pass between the two nuts 39 without interference as shown in FIG. 4. Near their tops, the side walls 48 flare outwardly at 49 and 50, again for the sake of increased capacity, and these portions of the side walls extend upwardly to a level somewhat below inclined top wall 44 and below an existing horizontal plate 51 in the dispenser in front of which the bolt 32 of prior art cash box 27 would normally engage.

The enlarged cash box includes a rearwardly offset lower front wall portion 52 and a top front wall spring portion 53 which is biased forwardly when in a relaxed state, FIGS. 5 and 6, the deflector 45 being joined to the top edge of this portion. A depending lip 54 on vertical front wall 40 serves the same purpose as the lip 29 on prior art cash box 27, namely, to engage with the fixed bracket 30 for positioning the cash box 28 relative to the adjacent front wall 55 of the dispenser. A horizontal ledge 56 at the top of front wall portion 52 actually rests upon the bracket 30 to support the weight of the front of the cash box 28.

Figure 7:
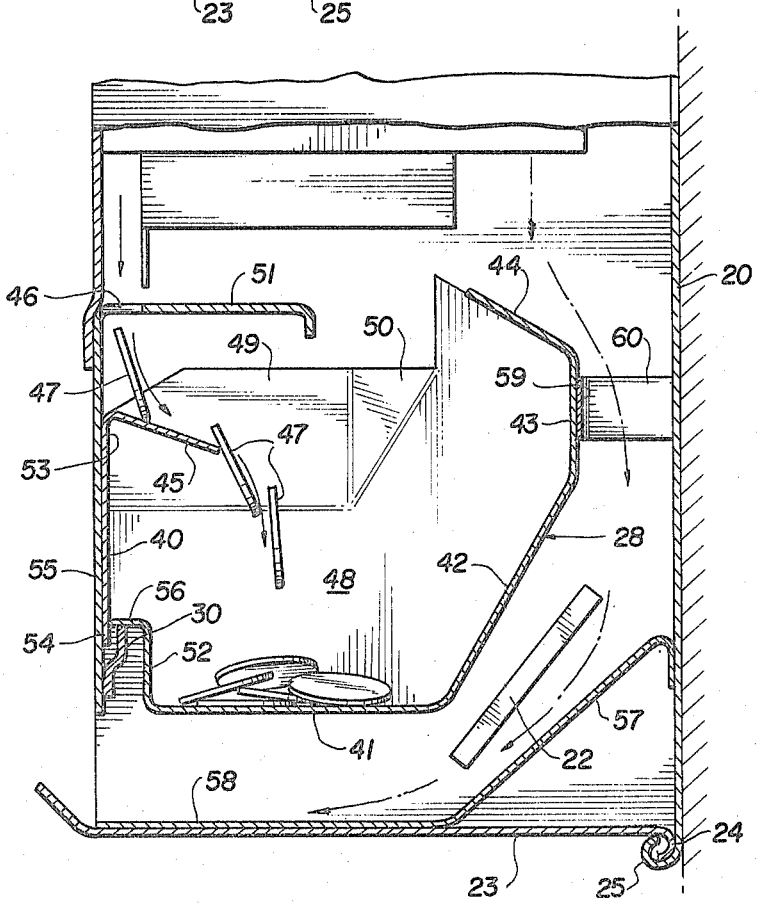
FIG. 7 is a similar view of the improved cash box and dispenser in the normal use position.

The only structural modification required in the existing dispenser comprises restructuring the prior art slide panel 35 for the released product units 22. As shown in FIGS. 6 and 7, a corresponding slide panel includes a rear inclined portion 57 to deflect the dropping product units 22 forwardly onto a horizontal portion 58 of the panel where they may easily be picked up by customers. The portion 58 is spaced below and parallel to the bottom wall 41. The inclined portion 57 is somewhat divergent rearwardly from the inclined wall 42 and forms therewith a passageway for the released product of sufficient width to avoid bridging of the product packs under any condition of dispensing.

A unique feature of the invention resides in the provision on the rear vertical wall 43 of a comparatively rigid fixed U-bracket 59 whose projecting arms 60 positively engage the vertical plate 20 when the dispenser is swung to the operative position shown in FIG. 7. Such positive engagement forces the cash box 28 forwardly against front wall 55 and the biased spring portion 53 is flattened out as shown in FIG. 7 to secure the cash box firmly between the wall 55 and plate 20 by spring pressure and without the necessity of a mechanical key lock.

In addition to the several convenience and structural features of the cash box above-described rendering it more practical and economical compared to the prior art, its capacity for holding quarters is more than doubled. The prior art box 27 can contain $43 in quarters while the cash box 28 can contain $90. All of this is achieved with virtually no structural modification of existing dispensers in the field. In terms of newly manufactured equipment, the overall manufacturing costs on a comparative basis would actually be reduced.

The described coaction of the bracket 59 with spring portion 53 also serves to prevent any of the falling coins 47 from entering between the front of cash box 28 and the dispenser wall 55. The many advantages of the invention should now be fully apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a product dispenser having an upper cabinet body for the storage of product units in one or more columns, a coin mechanism operable to release product units following insertion of proper coins into the mechanism, a bottom product outlet chamber adapted to contain a cash box, the improvement comprising a cash box of enlarged capacity within said chamber above the floor of the chamber and forwardly of the rear wall of the chamber and below a passageway in the dispenser through which deposited coins fall into the cash box, the cash box having a rear wall near and forwardly of the rear wall of said chamber and having a forward wall including a spring portion biased forwardly of the plane occupied by the forward wall of the cash box when in a relaxed state, a bracket element fixed to the rear wall of the cash box and positively engaging said rear wall of the chamber when the dispenser is in an upright use position, said bracket element then forcing the cash box forwardly in said chamber and causing said biased spring portion to engage a front wall of the chamber and yield so as to lie substantially in the plane occupied by the front wall of the cash box with the latter disposed flat against the front wall of the chamber, thereby firmly positioning the cash box in the chamber by spring pressure, and additional weight supporting means for the cash box within the chamber.

2. In a product dispenser as defined in claim 1, and said bracket element comprising a U-bracket fixed to the exterior of a vertical intermediate portion of the rear wall of the cash box and including two spaced rearwardly projecting substantially rigid arms engaging said rear wall of the chamber.

3. In a product dispenser as defined in claim 1, and said additional weight supporting means comprising a support bracket on the front wall of the chamber and having a vertical plate portion, a horizontal ledge on the cash box above the bottom wall thereof and immediately rearwardly of the cash box forward wall and resting on the vertical plate portion, and a depending lip on the cash box at the forward end of said horizontal ledge and engaging in a retainer cavity between the vertical plate portion of the support bracket and the front wall of the chamber.

4. In a product dispenser as defined in claim 1, and the cash box further comprising an inclined rear wall portion below the bracket element, a forwardly projecting inclined top wall above the bracket element, and substantially vertical side walls which are spaced apart a distance enabling the cash box to pass between two existing obstructions on the opposite side walls of said chamber, said side walls being outwardly flared forward of said obstructions, the top of the cash box being open forwardly of said top wall, and said top wall being joined to rear vertical extensions of said cash box side walls rearwardly of the flared portions thereof.

5. In a product dispenser as defined in claim 4, and a generally level coin deflector carried by the upper edge of said spring portion of the cash box forward wall near and inwardly of one cash box side wall and projecting rearwardly of the cash box forward wall to deflect coins toward the center of the cash box.

6. A cash box for use in a product dispenser having a coin mechanism and a cash box chamber below said mechanism, said chamber including an outlet passageway for dispensed product units around the rear of the cash box and below it, the cash box when installed in said chamber occupying the greatest available space in the chamber without interfering with the free passage of dispensed product units through said passageway, the cash box comprising a cup-like body having a horizontal bottom wall, a rising steeply inclined rear wall portion, a comparatively short vertical intermediate rear wall portion and a short inclined top wall serving to deflect falling product units into said passageway, the top of the cup-like body portion being open forwardly of said short top wall, the body portion having parallel vertical side walls including rear extensions joined to opposite side edges of the top wall and including upper outwardly flared side wall portions forwardly of the top wall and forwardly of the tops of the side wall extensions, the flared portions having top horizontal edges terminating somewhat below said top wall, said body portion further comprising a front vertical wall having a top forwardly biased spring portion extending between the side walls of the body portion and adapted to exert spring pressure on a fixed forward surface of the chamber in which the cash box is installed, and a substantially rigid bracket means fixed to said rear intermediate vertical wall portion of the cash box and adapted to bear against a fixed rear surface of said chamber to urge the cash box forwardly.

7. A cash box as defined in claim 6, and interengaging means on the cash box near its forward end and bottom adapted to engage cooperative interengaging supporting means in the cash box chamber.

8. A cash box as defined in claim 7, and a rearwardly projecting coin deflector plate on the front wall of said body portion near one side wall thereof and serving to deflect coins toward the center of the cash box.

9. A cash box as defined in claim 8, and said substantially rigid bracket means fixed to the rear intermediate vertical wall comprising a horizontal U-shaped bracket disposed substantially opposite to said top forwardly biased spring portion of the body portion front vertical wall.

* * * * *